US011819770B2

(12) United States Patent
Huang

(10) Patent No.: US 11,819,770 B2
(45) Date of Patent: Nov. 21, 2023

(54) RECREATIONAL WATER SLIDE DEVICE

(71) Applicant: BESTWAY INFLATABLES & MATERIAL CORP., Shanghai (CN)

(72) Inventor: Shuiyong Huang, Shanghai (CN)

(73) Assignee: BESTWAY INFLATABLES & MATERIAL CORP., Shanghai (CN)

( * ) Notice: Subject to any disclaimer, the term of this patent is extended or adjusted under 35 U.S.C. 154(b) by 100 days.

(21) Appl. No.: 17/563,336

(22) Filed: Dec. 28, 2021

(65) Prior Publication Data

US 2022/0249963 A1 Aug. 11, 2022

(30) Foreign Application Priority Data

Feb. 8, 2021 (CN) ..... 202120366945.0

(51) Int. Cl.
*A63G 21/18* (2006.01)

(52) U.S. Cl.
CPC ..... *A63G 21/18* (2013.01)

(58) Field of Classification Search
CPC ..... A63G 21/18; A63G 31/12; A63G 31/007; A63B 2009/008
USPC ..... 472/117, 128
See application file for complete search history.

(56) References Cited

U.S. PATENT DOCUMENTS

| | | | | |
|---|---|---|---|---|
| 5,154,671 | A * | 10/1992 | Smollar | A63G 21/18 472/117 |
| 6,062,983 | A * | 5/2000 | Butsook | A63G 21/18 4/488 |
| 2009/0029785 | A1* | 1/2009 | McKee | A63G 31/12 472/117 |
| 2010/0285893 | A1* | 11/2010 | Leimone | A63G 21/18 472/117 |
| 2016/0136528 | A1* | 5/2016 | Sgromo | A63G 21/18 472/117 |
| 2020/0353371 | A1* | 11/2020 | Huang | A63G 21/18 |

* cited by examiner

*Primary Examiner* — Kien T Nguyen
(74) *Attorney, Agent, or Firm* — DICKINSON WRIGHT PLLC

(57) ABSTRACT

A recreational water slide device is provided including an upper sheet and a lower sheet, together defining an inflatable chamber. A connecting sheet is disposed under the inflatable chamber and comprises an edge that is connected to the lower sheet. A water storage chamber is formed between the connecting sheet and the lower sheet with an opening, through which water can pass, between the inflatable chamber and the connecting sheet.

20 Claims, 4 Drawing Sheets

RECREATIONAL WATER SLIDE DEVICE

CROSS-REFERENCE TO RELATED APPLICATION

This Application claims priority from Chinese Application CN202120366945.0, filed Feb. 8, 2021 in China, the disclosure of which is incorporated herein by reference in its entirety.

BACKGROUND

1. Field

Apparatuses and methods consistent with exemplary embodiments relate to a recreational device, and in particular to a recreational water slide device.

2. Description of the Related Art

Recreational water slide devices, such as water slides, are very popular. A water slide is provided with a slide which can be disposed on the ground, and a user can slide from a top to a bottom of the water slide.

A water spray device may be disposed on the slide and used to lubricate the slide.

SUMMARY

Example embodiments may address at least the above problems and/or disadvantages and other disadvantages not described above. Also, example embodiments are not required to overcome the disadvantages described above, and may not overcome any of the problems described above.

One or more example embodiments may provide a water slide device comprising an upper sheet and a lower sheet, together defining an inflatable chamber, and a connecting sheet disposed under the inflatable chamber. The connecting sheet comprises an edge connected to the lower sheet and forming a water storage chamber between the connecting sheet and the lower sheet. The water storage chamber has an opening, through which water may pass, between the inflatable chamber and the connecting sheet. When the inflatable chamber is pressed, water in the water storage chamber may form waves and/or sprays through the opening.

The water slide device may further comprise a slide way connected to the connecting sheet and a water spray pipe connected to the slide way and configured to spray water therefrom into the water storage chamber.

The water spray pipe may extend higher than the connecting sheet and may thereby be configured to at least partially block water from flowing from the opening to the slide way.

The inflatable chamber, formed by the upper sheet and the lower sheet may comprise a plurality of extension parts, each extending over the water spray pipe, and a notch between the extension parts.

The water spray pipe may be made of a flexible thermoplastic plastic.

The water spray pipe may comprise a plurality of first water spray holes configured to spray water from the water spray pipe toward the upper sheet.

The water spray pipe may comprise a plurality of second water spray holes configured to spray water from the water spray pipe toward the opening.

The water slide device may further comprise and at least one ribbon disposed within the inflatable chamber and connecting the upper sheet and the lower sheet.

The water slide device may further comprise a connecting pipe comprising a first end connected to the water spray pipe and a second end, opposite the first end, configured to be connected to a water supply device.

The water slide device may further comprise an inflatable water pool, wherein the connecting sheet forms a pool bottom of the inflatable water pool.

The slide way may comprise a first end part, connected to the connecting sheet, and a second end part, connected to a buffer part.

The buffer part may be a water pool.

According to an aspect of another example embodiment, a water slide device may comprise: a slide way; and a ramp portion connected to a first end of the slide way, the ramp portion comprising: a wedge-shaped ramp, and a connecting sheet disposed below the wedge-shaped ramp and connected, along an outer circumference thereof, to the wedge-shaped ramp, thereby defining a water storage chamber between the wedge-shaped ramp and the connecting sheet, the water storage chamber comprising an opening facing the slide way.

BRIEF DESCRIPTION OF THE DRAWINGS

The above and/or other aspects will become apparent and more readily appreciated from the following description of example embodiments, taken in conjunction with the accompanying drawings, in which.

DETAILED DESCRIPTION

Figure 1:
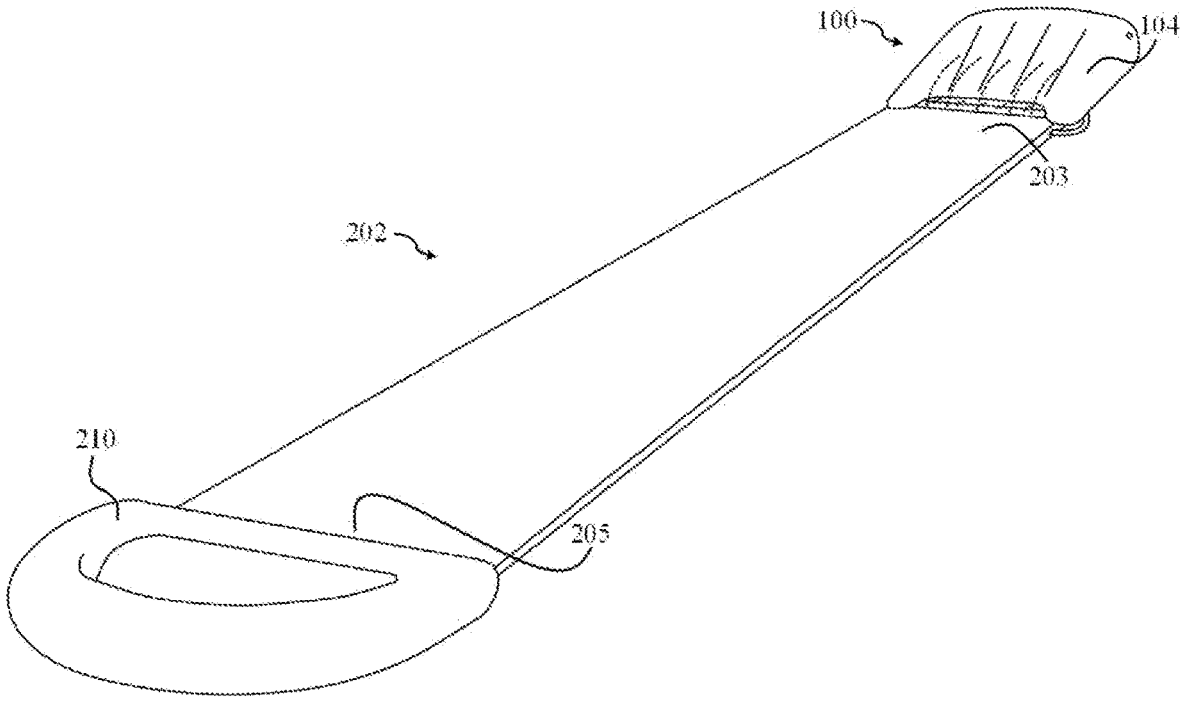
FIG. 1 is a schematic structural diagram of a recreational water slide device according to an example embodiment.

Reference will now be made in detail to example embodiments which are illustrated in the accompanying drawings, wherein like reference numerals refer to like elements throughout. In this regard, the example embodiments may have different forms and may not be construed as being limited to the descriptions set forth herein.

It will be understood that the terms "include," "including", "comprise, and/or "comprising," when used in this specification, specify the presence of stated features, integers, steps, operations, elements, and/or components, but do not preclude the presence or addition of one or more other features, integers, steps, operations, elements, components, and/or groups thereof.

It will be further understood that, although the terms "first," "second," "third," etc., may be used herein to describe various elements, components, regions, layers and/or sections, these elements, components, regions, layers and/or sections may not be limited by these terms. These terms are only used to distinguish one element, component, region, layer or section from another element, component, region, layer or section.

As used herein, the term "and/or" includes any and all combinations of one or more of the associated listed items. Expressions such as "at least one of," when preceding a list of elements, modify the entire list of elements and do not modify the individual elements of the list.

Various terms are used to refer to particular system components. Different companies may refer to a component by different names—this document does not intend to distinguish between components that differ in name but not function.

Matters of these example embodiments that are obvious to those of ordinary skill in the technical field to which these exemplary embodiments pertain may not be described here in detail.

FIG. 1 is a schematic diagram of a recreational water slide device of according to an example embodiment. In FIG. 1, the recreational water slide device is a slide 100 comprising a slide way 202, having a first end part 203 and a second end part 205. An upper portion 102 is connected to the first end part 203, and a lower portion 210 is connected to the second end part 205. The lower portion 210 may be a buffer part 210, as shown in FIG. 1, disposed at the second end part 205 of the slide way 202.

Figure 5:
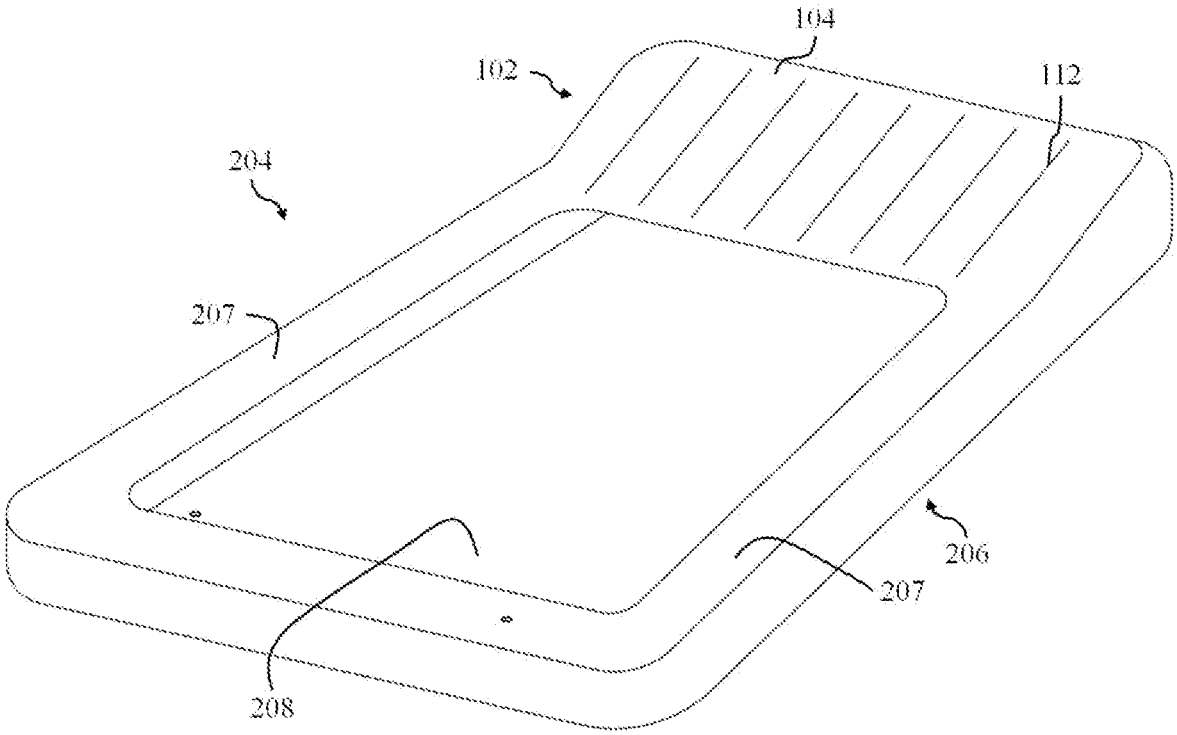
FIG. 5 is a schematic structural diagram of a recreational water slide device according to an example embodiment.

The buffer part 210 may comprise an annular or circular buffer air cushion. According to one or more example embodiments, the buffer part 210 may be a buffer water pool. According to one or more alternate examples, the lower portion 210 may be an inflatable pool 204, as shown in FIG. 5.

Figure 2:
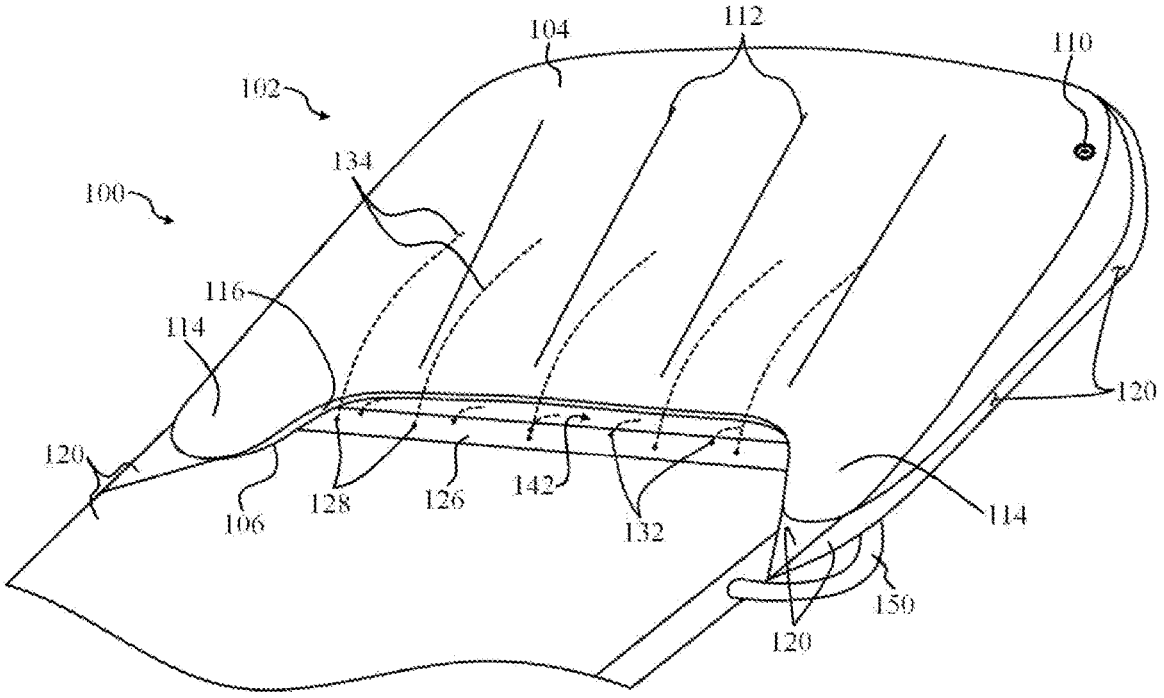
FIG. 2 is a schematic structural diagram of a part of recreational water slide device according to an example embodiment.
Figure 3:
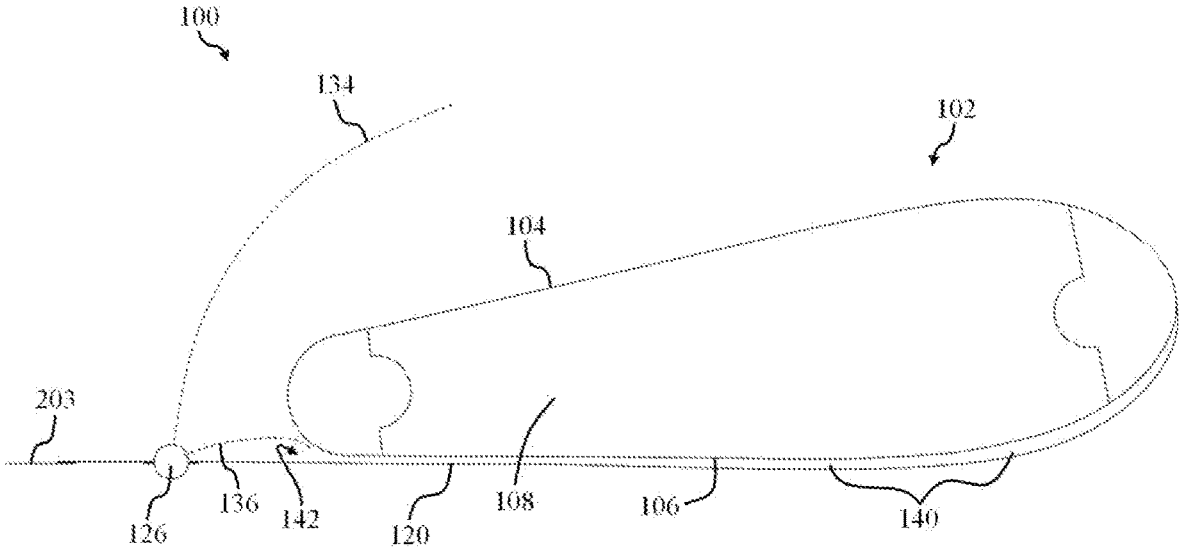
FIG. 3 is a schematic cross-sectional diagram of the recreational water slide device of FIG. 2.

As shown in FIGS. 1-3, the slide 100 comprises the slide way 202, the upper portion 102 connected to a first end part 203 of the slide way 202, and the lower portion 210 connected to a second end part 205 of the slide way 202. The upper portion 102 includes an upper sheet 104 forming an inclined surface, so that a user can slide down from the upper sheet 104 onto the slide way 202. As shown in FIGS. 2 and 3, the upper portion 102 further includes a lower sheet 106, a connecting sheet 120, a water spray pipe 126, and a connecting pipe 150. The upper sheet 104 and the lower sheet 106 are connected together and define an inflatable chamber. According to an example aspect, the upper portion further includes two extension parts 114; as shown in FIG. 3, which are portions of the inflatable chamber, formed by the upper sheet 104 and lower sheet 106, which extend toward the slide way 202. The connecting sheet 120 is disposed below the lower sheet 106, and edges of the connecting sheet 120 are connected to the lower sheet 106 and to the first end part 203 of the slide way 202, so that a water storage chamber 140 with an opening 142 is formed between the upper portion 102 and the connecting sheet 120. Parts of the edge of the connecting sheet 120 are also connected to the extension parts 114. The flexible water spray pipe 126 is attached between the connecting sheet 120 and the first end part 203 of the slide way 202, extending in a widthwise direction of the slide way 202. One end of the water spray pipe 126 is connected to the connecting pipe 150, and the water spray pipe 126 is provided with one or more rows of water spray holes in a lengthwise direction of the water spray pipe 126, and the one or more rows of water spray holes may include first water spray holes 128 spraying out first water columns 134 and second water spray holes 132 spraying out second water columns 136, as shown in FIG. 3. The connecting pipe 150 connects a water source to the water spray pipe 126. The water spray pipe 126 is arranged adjacent to the opening 142 of the water storage chamber 140, and may be arranged to be parallel to the opening 142 so as to spray water into the water storage chamber 140 in an evenly distributed manner. As shown in FIG. 2, a notch 116 may be formed between the two extension parts 114, and due to the arrangement of the notch 116, the water columns sprayed out from the water spray holes may fall on the upper sheet 104 of the upper portion 102 and/or the opening 142 of the water storage chamber 140 without restriction. In other words, in an example aspect in which the notch 116 is not provided, paths of the first water columns 134 may be blocked by the upper portion, and thus, the first water columns 134 may not fall on the upper sheet 104 of the upper portion 102. As shown in FIG. 2, the upper sheet 104 may include a plurality (e.g. four) of recess parts 112 each extending in a sliding direction. The recess parts 112 may guide a flow of water falling on the upper sheet 104, so that the water falling on the upper sheet 104 flows into the water storage chamber 140 through the opening 142. Furthermore, the inflatable chamber formed by the upper sheet 104 and the lower sheet 106 may be filled with gas, namely, the upper portion 102 is inflatable slide. The upper sheet 104 of the upper portion 102 includes an inflation valve 110, and the inflation valve 110 is used for controlling a direction of gas flow as well as gas pressure.

According to an example aspect, the upper sheet 104 and the lower sheet 106 can be integrally arranged, such that there is a single, integrated sheet comprising and integrated upper half part 104 and an integrated lower half part 106. A size of the upper sheet/integrated upper half part 104 may be larger than that of the lower sheet/integrated lower half part 106. Alternately, the size of the upper sheet/integrated upper half part 104 may be smaller than that of the lower sheet/integrated lower half part 106.

One or both of the slide way 202 and the upper portion 102 may be water-filled.

According to one or more alternate example embodiments, the water spray pipe 126 may be arranged on the lower portion 210 or on the slide way 202, for example, on the second end part 205 and/or two sides of the slide way 202.

According to an alternate example aspect, rather than the straight line as shown in FIG. 2, the lengthwise axis of the water spray pipe may be curved.

One end of the connecting pipe 150 is connected to one end of the water spray pipe 126, and an opposite end of the connecting pipe 150 is configured to attach to a water source or other water supply device. For example, the opposite end of the connecting pipe 150 may be connected to a water spray devices disposed on the lower portion 210. According to another example aspect, the one end of the connecting pipe 150 may be connected to both an end of the water spray pipe 126 disposed at or connected to the first end part 203 of the slide way 202 or the upper portion 102 and to and end of another water spray device (not shown) disposed at or connected to the second end part 205 and/or two sides of the slide way 202 or the lower portion 210.

According to an alternate example aspect, the water spray pipe 126 may be directly connected to a water supply device without the connecting pipe 150 disposed therebetween. The water spray pipe may include a water valve, and the water valve may be configured to control a switching of a direction of water flow as well being configured to control a water pressure, to thereby enable adjustment of a height of water columns sprayed out from the water spray pipe 126.

According to example aspects, the plurality of extension parts 114 may be two, three, four, or five, extension parts, or more, as would be understood by one of skill in the art.

The plurality of recess parts 112 may be formed by tensioning the upper sheet 104 with a corresponding plurality of ribbons disposed within the inflatable chamber. The plurality of recess parts 112 may be two, three, four, or five recess parts, or more, as would be understood by one of skill in the art. Alternately, there may be only a single recess part 112.

Figure 4:
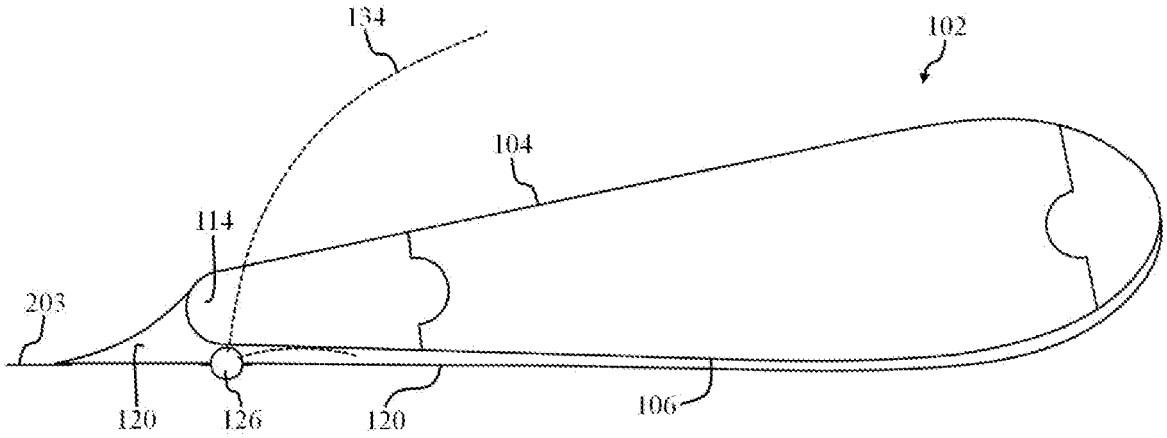
FIG. 4 is a schematic cross-sectional diagram of another position of the recreational water slide device of FIG. 2.

FIGS. 3 and 4 are schematic cross-sectional diagrams of two different arrangements of elements of the water slide 100. It is noted that the extension parts 114 are shown in FIG. 4, but are not shown in FIG. 3, so that the water spray pipe 126 in FIG. 3 is shown as separated from the upper portion 102 in FIG. 3, while the water spray pipe 126 is shown as located below the extension parts 114 in FIG. 4. The ribbons 108 are disposed within the inflatable chamber and connect the upper sheet 104 and the lower sheet 106. An edge of the connecting sheet 120 is connected to the lower sheet 106, and the water storage chamber 140 is provided with the opening 142 towards the water spray pipe 126. When the water spray pipe 126 is filled with water, the water is sprayed out through the water spray holes of the water spray pipe 126. The water spray holes may be distributed into two rows in the lengthwise direction of the water spray pipe 126 to form a plurality (e.g. five) first water spray holes 128 and a plurality (e.g. five) second water spray holes 132. Water columns sprayed out from the first water spray holes 128 and water columns sprayed out from the second water spray holes 132 are first water columns 134 and second water columns 136, respectively. The water spray pipe 126 and the first and second water spray holes 128 and 132 may be configured such that first water columns 134 fall on the upper sheet 104, the second water columns 136 fall at the opening 142 of the water storage chamber 140, and some of the water columns flow into the water storage chamber 140.

According to one or more example embodiments arrangement of the positions and orientations of the water spray pipe 126 and the water storage chamber 140 may be configured such that when a user slides exerts pressure on the upper portion 102, the water in the water storage chamber 140, can form waves or sprays to gush out through the opening 142; and at the same time, the water columns 134 and 136 sprayed out from the water spray pipe 126 can lubricate the water slide 100 device.

According to one or more example embodiments, due to the arrangement of the ribbons 108, for example, as shown in FIG. 3, the recess parts 112 are formed in the upper sheet 104 so as to guide a flow direction of water. In this way, a structural strength of the slide body may also be improved. According to an example aspect, as shown, for example, in FIG. 3, opposite ends of each of the plurality of ribbons 108 may include a semi-circular cut-out treatment configured to disperse a concentration of stress. According to an example aspect, as shown, for example in FIGS. 3 and 4, the water spray pipe 126 may be positioned so that it extends higher than the connecting sheet 120, and accordingly may have a blocking effect. For example, when a water level in the water storage chamber 140 gradually increases and the slide body is not pressed, the water spray pipe 126 may function as a weir such that water in the water storage chamber 140 and water at the opening 142 are collected instead of flowing toward the slide way 202.

As shown in FIGS. 2 and 4, parts of the edge of the connecting sheet 120 may be connected to the extension parts 114, effectively wrapping ends of the water spray pipe 126, defining a space with a closed periphery being. In this way, the water spray pipe 126 and the connecting sheet 120 may jointly block the water flow at the opening 142 in a lengthwise direction of the slide way 202 and in the direction of two sides of the opening, so that water at the opening 142 is collected instead of flowing out of the water slide 100.

According to an example aspect, the water spray pipe 126 may be a bent pipe including a plurality of bent parts and may have a blocking effect similar to a weir in multiple directions. For example, the water spray pipe 126 may be a U-shaped pipe having a middle section parallel to the opening 142, and having two opposing side sections arranged on the connecting sheet 120 and disposed at opposite sides of the opening 142. In this way, a U-shaped pipe 126 may block water flowing toward the second end part 205 at the opening 142. Accordingly, the water at the opening 142 may be collected instead of flowing out of the water slide 100.

According to one or more example aspects, the water spray holes may be arranged into one single row, and water columns sprayed out from the water spray holes may fall on the upper sheet 104 and flow into the water storage chamber 140 via the upper sheet 104. Alternately, the water spray holes may be arranged into two rows, and water columns sprayed out from one of the rows of water spray holes may fall at the opening 142 of the water storage chamber 140 and flow into the water storage chamber 140 through the opening 142. According to yet another alternate aspect, the water spray holes may be arranged in three or more rows.

According to one or more example embodiments, when a length of the upper portion 102 is large, the water storage chamber 140 can be gradually extruded toward the opening 142 by a process of a user gradually sliding downward along the upper sheet 104, and accordingly, the water in the water storage chamber 140 may be gradually pushed to flow toward the opening 142.

According to one or more example embodiments, the water spray pipe 126 may be omitted. In such a case, when the water slide is used, the water storage chamber 140 may be filled with water by directly or indirectly injecting water into the water storage chamber 140. When a user slides downward from the upper portion 102 along the upper sheet 104, the water storage chamber 140 is extruded and drives the water in the water storage chamber 140 to flow toward the opening 142. When the water gushes out through the opening 142, a wave and/or spray experience effect can be achieved.

The water spray pipe may be made of a flexible thermoplastic plastic, such as PVC (polyvinyl chloride) or PU (polyurethane), or another material as would be understood by one of skill in the art.

Figure 6:
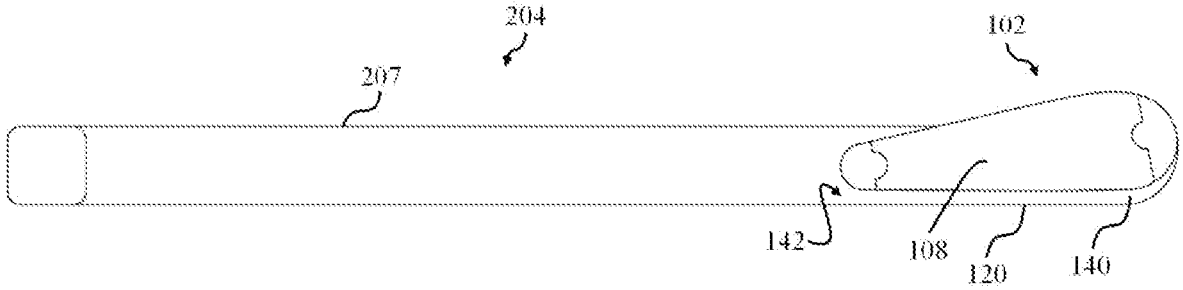
FIG. 6 is a schematic cross-sectional diagram of the recreational water slide device of FIG. 5.

As shown in FIGS. 5 and 6, the slide 100 may comprise an inflatable pool 204. In this case, the slide 100 comprises an upper portion 102 including a connecting sheet 120, an upper sheet 104, and recess parts 112, as discussed above. The slide 100 also includes the inflatable pool 204 including a pool body 206 with a pool wall and a pool bottom 208, wherein the connecting sheet 120 is connected to the pool bottom 208 of the inflatable pool 204. When the inflatable pool 204 is filled with water, the water flows into the water storage chamber 140 through the opening 142 of the water storage chamber 140, and when the user slides downward from the upper portion 102, along the upper sheet 104, the water storage chamber 140 is extruded and drives the water in the water storage chamber 140 to flow toward the opening 142. When the water gushes out through the opening 142, a wave and/or spray experience effect can be achieved. As shown, for example, in FIG. 5, the upper sheet 104 may be integrally formed as an extension of a top wall 207 of the pool body 206 of the inflatable pool 204. As shown, for example, in FIG. 6, the connecting sheet 120 may be integrally formed as an extension of the pool bottom 208. In this way, the inflatable pool 204, the upper portion 102, and the connecting sheet 120 may an integral structure. A water spray pipe 126 may be connected to the connecting sheet 120 and to the pool bottom 208 of the inflatable pool 204, and water columns may be sprayed out toward the upper sheet 104 and the opening 142 so as to lubricate the slide and to generate waves and/or sprays.

The inflatable pool 204 and the inflatable chamber of the upper portion 102 may be in communication with each other, forming a common inflatable body.

According to example aspects of some embodiments, one or more elements of the slide 100, such as the upper portion 102, the connecting sheet 120, the water spray pipe 126, and the slide way 203, may be connected to other of the elements of the slide 100 by high-frequency welding.

According to one or more example embodiments, in using a water slide described herein, a user may rush to the slide from a distance, slide from the upper portion along the slide way, and then slide toward the second end part of the slide way, and enters the buffer water pool. According to one or more example aspects, the second end part 205 of the slide way may be detachably connected to the buffer water pool. Alternately, the second end part 205 of the slide way may be connected to the buffer water pool by high-frequency welding.

A water slide described herein may be arranged to that the ground where the buffer water pool is located is lower than the ground where the second end part 205 of the slide way is located. Alternately, the slide may be disposed on level ground.

A width of the buffer water pool may be greater than that of the slide way.

It may be understood that the exemplary embodiments described herein may be considered in a descriptive sense only and not for purposes of limitation. Descriptions of features or aspects within each exemplary embodiment may be considered as available for other similar features or aspects in other exemplary embodiments.

While exemplary embodiments have been described with reference to the figures, it will be understood by those of ordinary skill in the art that various changes in form and details may be made therein without departing from the spirit and scope as defined by the following claims.

What is claimed is:

1. A water slide device comprising:

an inflatable chamber comprising an upper sheet and a lower sheet;

a connecting sheet disposed under the inflatable chamber and comprising an edge connected to the lower sheet; and a water storage chamber defined between the connecting sheet and the lower sheet, the water storage chamber comprising:

an opening through which water may pass between the inflatable chamber and the connecting sheet, two opposing closed sides, and a rear closed end, opposite the opening.

2. The water slide device according to claim 1, further comprising:

a slide way connected to the connecting sheet; and a water spray pipe connected to the slide way and configured to spray water therefrom into the water storage chamber.

3. The water slide device according to claim 2, the water spray pipe comprising a plurality of first water spray holes configured to spray water from the water spray pipe toward the upper sheet.

4. The water slide device according to claim 2, further comprising a connecting pipe comprising a first end connected to the water spray pipe and a second end, opposite the first end, configured to connected to a water supply device.

5. The water slide device according to claim 2, the slide way comprising a first end part connected to the connecting sheet and a second end part connected to a buffer part.

6. The water slide device according to claim 5, the buffer part comprising a pool.

7. The water slide device according to claim 1, further comprising at least one ribbon disposed within the inflatable chamber and connecting the upper sheet and the lower sheet.

8. The water slide device according to claim 1, further comprising an inflatable pool, wherein the connecting sheet forms a pool bottom of the inflatable pool.

9. A water slide device comprising:

an inflatable chamber comprising an upper sheet and a lower sheet;

a connecting sheet disposed under the inflatable chamber, the connecting sheet comprising an edge connected to the lower sheet; and a water storage chamber defined between the connecting sheet and the lower sheet, the water storage chamber comprising an opening through which water may pass between the inflatable chamber and the connecting sheet;

a slide way connected to the connecting sheet; and a water spray pipe connected to the slide way and configured to spray water therefrom into the water storage chamber;

wherein the water spray pipe extends higher than the connecting sheet and is thereby configured to at least partially block water from flowing from the opening to the slide way.

10. The water slide device according to claim 9, wherein the water spray pipe is made of a flexible thermoplastic plastic.

11. A water slide device comprising:

an inflatable chamber comprising an upper sheet and a lower sheet;

a connecting sheet disposed under the inflatable chamber, the connecting sheet comprising an edge connected to the lower sheet; and a water storage chamber defined between the connecting sheet and the lower sheet, the water storage chamber comprising an opening through which water may pass between the inflatable chamber and the connecting sheet;

a slide way connected to the connecting sheet; and a water spray pipe connected to the slide way and configured to spray water therefrom into the water storage chamber;

wherein the water spray pipe extends higher than the connecting sheet and is thereby configured to at least partially block water from flowing from the opening to the slide way; and wherein the inflatable chamber, formed by the upper sheet and the lower sheet, comprises:

a plurality of extension parts each extending over the water spray pipe; and a notch extending between the extension parts.

12. A water slide device comprising:

an inflatable chamber comprising an upper sheet and a lower sheet;

a connecting sheet disposed under the inflatable chamber, the connecting sheet comprising an edge connected to the lower sheet; and a water storage chamber defined between the connecting sheet and the lower sheet, the water storage chamber comprising an opening through which water may pass between the inflatable chamber and the connecting sheet;

a slide way connected to the connecting sheet; and a water spray pipe connected to the slide way and configured to spray water therefrom into the water storage chamber;

wherein the water spray pipe comprises:

a plurality of first water spray holes configured to spray water in a first direction from the water spray pipe toward the upper sheet; and a plurality of second water spray holes configured to spray water in a second direction, different from the first direction, from the water spray pipe toward the opening.

13. A water slide device comprising:

a slide way; and a ramp portion connected to a first end of the slide way, the ramp portion comprising:

a wedge-shaped ramp, and a connecting sheet disposed below the wedge-shaped ramp and connected, along an outer circumference thereof, to the wedge-shaped ramp, thereby defining a water storage chamber between the wedge-shaped ramp and the connecting sheet, the water storage chamber comprising an opening facing the slide way.

14. The water slide device according to claim 13, further comprising a water spray pipe configured to spray water into the water storage chamber.

15. The water slide device according to claim 14, wherein the water spray pipe is further configured to spray water onto an upper surface of the wedge-shaped ramp.

16. The water slide device according to claim 13, the wedge-shaped ramp comprising an inflatable chamber.

17. The water slide device according to claim 16, the inflatable chamber comprising a first extension portion, extending from a first side of the inflatable chamber toward the slide way, and a second extension portion, extending from a second side of the inflatable chamber toward the slide way.

18. The water slide device according to claim 17, the inflatable chamber further comprising a groove extending between the first extension portion and the second extension portion and configured to guide water into the water storage chamber.

19. The water slide device according to claim 13, the connecting sheet being connected to the first end of the slide way, and further comprising an inflatable bumper connected to a second end of the slide way.

20. The water slide device according to claim 13, the connecting sheet connected to the first end of the slide way, and further comprising an inflatable pool connected to a second end of the slide way.

* * * * *